US008893772B2

(12) United States Patent
Henderson et al.

(10) Patent No.: US 8,893,772 B2
(45) Date of Patent: Nov. 25, 2014

(54) MODULAR APPARATUS FOR ASSEMBLING TUBULAR GOODS

(76) Inventors: Kris Henderson, Lafayette, LA (US); Lee J. Matherne, Jr., Lafayette, LA (US); Lee M. Robichaux, Lafayette, LA (US)

( * ) Notice: Subject to any disclaimer, the term of this patent is extended or adjusted under 35 U.S.C. 154(b) by 308 days.

(21) Appl. No.: 13/597,429

(22) Filed: Aug. 29, 2012

(65) Prior Publication Data

US 2013/0075077 A1 Mar. 28, 2013

Related U.S. Application Data

(60) Provisional application No. 61/528,350, filed on Aug. 29, 2011.

(51) Int. Cl.

| | |
|---|---|
| ***E21B 19/24*** | (2006.01) |
| ***E21B 19/08*** | (2006.01) |
| ***E21B 19/00*** | (2006.01) |
| ***E21B 19/02*** | (2006.01) |
| ***E21B 19/16*** | (2006.01) |

(52) U.S. Cl.

CPC ..... *E21B 19/08* (2013.01); *E21B 19/00* (2013.01); *E21B 19/02* (2013.01); *E21B 19/16* (2013.01)

USPC ..... 166/77.1; 166/77.53; 166/77.52

(58) Field of Classification Search

USPC ..... 166/77.1, 77.52, 77.53, 75.14; 175/423

See application file for complete search history.

(56) References Cited

U.S. PATENT DOCUMENTS

| | | | | |
|---|---|---|---|---|
| 7,896,111 | B2 * | 3/2011 | Slack | 175/423 |
| 7,909,120 | B2 * | 3/2011 | Slack | 175/423 |
| 8,042,626 | B2 * | 10/2011 | Slack | 175/423 |
| 8,210,268 | B2 * | 7/2012 | Heidecke et al. | 166/380 |
| 8,365,834 | B2 * | 2/2013 | Liess et al. | 166/382 |
| 8,783,339 | B2 * | 7/2014 | Sinclair et al. | 166/77.52 |
| 2006/0124293 | A1 * | 6/2006 | Juhasz et al. | 166/77.1 |
| 2008/0059073 | A1 * | 3/2008 | Giroux et al. | 702/9 |
| 2012/0211244 | A1 * | 8/2012 | Heidecke et al. | 166/380 |

* cited by examiner

*Primary Examiner* — Kenneth L Thompson

(74) *Attorney, Agent, or Firm* — Ted M. Anthony

(57) ABSTRACT

A modular pipe gripping assembly has a universal actuator assembly having a control fluid swivel. An external pipe gripping assembly can be attached to the actuator assembly for gripping the external surface of a section of pipe. Alternatively, the external pipe gripping assembly can be quickly and easily removed and replaced with an internal pipe gripping assembly for gripping the internal surface of a section of pipe. Control fluid pressure is trapped within the actuator assembly, but relieved from a fluid swivel, permitting high speed rotation of the modular pipe gripping assembly and preserving swivel seal life.

10 Claims, 14 Drawing Sheets

MODULAR APPARATUS FOR ASSEMBLING TUBULAR GOODS

CROSS REFERENCES TO RELATED APPLICATION

Priority of U.S. Provisional Patent Application Ser. No. 61/528,350, filed Aug. 29, 2011, incorporated herein by reference, is hereby claimed.

STATEMENTS AS TO THE RIGHTS TO THE INVENTION MADE UNDER FEDERALLY SPONSORED RESEARCH AND DEVELOPMENT

NONE

BACKGROUND OF THE INVENTION

1. Field of the Invention

The present invention pertains to an apparatus for assembling and installing pipe in a well. More particularly, the present invention pertains to a pipe running tool that can rotate at high speed, and selectively grip pipe either internally or externally. More particularly still, the present invention pertains to a pipe running tool that can be quickly and easily converted between internal and external pipe gripping simply by changing out modular components.

2. Brief Description of the Prior Art

Efficiency in connection with oil and gas operations, especially in terms of drilling rate, has been addressed with great earnest for many years. However, drilling rate is not the only variable affecting operational costs; pipe string assembly and installation rate typically has about the same cost-effect as drilling rate. The present invention addresses an increase in efficiency of such pipe string assembly and installation operations (and a resulting decrease in costs associated with such operations) without sacrificing safety concerns.

Once a well has been drilled to a desired depth, large diameter and relatively heavy pipe known as "casing" is frequently installed in the well. During installation in a well, casing is typically inserted into the pre-drilled well bore in a number of separate sections of substantially equal length referred to as "joints." The joints, which generally include threaded connections, are typically joined end-to-end at the earth's surface (typically from a drilling rig) in order to form a substantially continuous "string" of pipe that reaches downward into a well. After the casing is installed within the well bore, the pipe is usually cemented in place.

During the pipe installation process, additional sections of pipe are added to the upper end of the pipe string at the rig in order to increase the overall length of the pipe string and its penetration depth in a well bore. The addition of pipe sections at the surface is repeated until a desired length of pipe is inserted into the well. The rate of assembly and installation of the casing can amount to many hours of total work time which, in turn, equates to higher costs. As such, time reduction in pipe string assembly and installation operations can result in significant cost reduction.

Conventional casing installation operations typically involve specialized crews and equipment mobilized to a well site for the specific purpose of assembling casing and installing such casing into a well. Recently, a method of running casing using a rig's top drive system, together with specialized casing running tools (RT's), has become increasingly popular. In many cases, casing can be run more efficiently and for less cost using an RT, compared to conventional casing crews and equipment, because RT's can be used to pick up and stab joints of casing and to provide torque to make up threaded casing connections. As a result, specialized casing tongs are frequently not needed, and fewer personnel are required on and around the rig floor during the casing running operations.

In most cases, a RT is connected immediately below a rig's top drive unit prior to commencement of casing operations. A single-joint elevator, supported by a RT, is typically used to lift individual joints of casing from a V-door or pipe rack into a derrick in vertical alignment over a well. The top drive and attached RT are lowered until the RT is proximate to the top of the new joint being added. The slips of the RT are set on the new joint of casing, and the top drive is actuated to apply the required torque (through the RT) to make up the casing to the upper end of the casing string previously installed in a well. At times, during the lowering of the pipe string into the well, the pipe string can be rotated and/or reciprocated using the RT to facilitate installation in the well.

In certain circumstances, it is beneficial for an RT to grip a pipe section internally (i.e., within the internal bore of such pipe), while in other circumstances it may be better to grip such pipe externally (i.e., on the outer surface of such pipe). However, because such functions generally require very different RT equipment configurations, most RT systems are designed for either internal gripping of pipe or external gripping of pipe, but cannot be converted from one method to the other. Further, existing RT systems generally provide for relatively low rotational rate (rpm), primarily due to limitations associated with hydraulic swivel seals.

In economic interest, the feed rate during the lowering of a pipe string into a well should be maximized, within the limits of safety considerations. Thus, there is a need for an RT that can pick up, assemble, rotate, and reciprocate casing or other pipe during installation operations, while having the ability to fill up fluids and compensate such casing or pipe during critical make up or break out procedures. The RT should allow for quick and efficient conversion between internal and external pipe gripping methods, while also permitting high rotational rates.

SUMMARY OF THE PRESENT INVENTION

The present invention comprises a modular RT that can pick up, assemble, rotate, and reciprocate casing or other pipe during installation operations, while having the ability to fill up fluids and compensate such casing or pipe during critical make up or break out procedures.

In the preferred embodiment, the present invention comprises a modular RT that can be used in connection with top drive systems to quickly, efficiently and safely assemble and install tubular goods (including, without limitation, large diameter or heavy weight casing) into a well. The modular RT of the present invention can permit gripping of pipe either internally (i.e., within the internal bore of such pipe) or externally (i.e., on the outer surface of such pipe). By simply changing out certain modular components, the tool can be quickly modified between an internal and an external gripping tool that allows gripping of larger diameter pipe.

The RT of the present invention further comprises a dynamic fluid swivel that conveys control fluid (typically hydraulic oil) to different parts of the RT in order to facilitate actuation of said RT, while permitting rotation of said RT and the application of torque to pipe gripped by said RT. However, the RT of the present invention isolates elevated control fluid pressures from such swivel during rotation of the RT. As a result, the fluid seals of said fluid swivel last much longer than conventional swivel seal assemblies, while permitting rotation at much higher rates than conventional RT's.

Any dimensions set forth herein and in the attached drawings are illustrative only and are not intended to be, and should not be construed as, limiting in any way.

BRIEF DESCRIPTION OF THE DRAWINGS

The foregoing summary, as well as the following detailed description of the preferred embodiments, is better understood when read in conjunction with the appended drawings. For the purpose of illustrating the invention, the drawings show certain preferred embodiments. It is understood, however, that the invention is not limited to the specific methods and devices disclosed. Further, dimensions, materials and part names are provided for illustration purposes only and not limitation.

DETAILED DESCRIPTION OF A PREFERRED EMBODIMENT OF THE INVENTION

Figure 1:
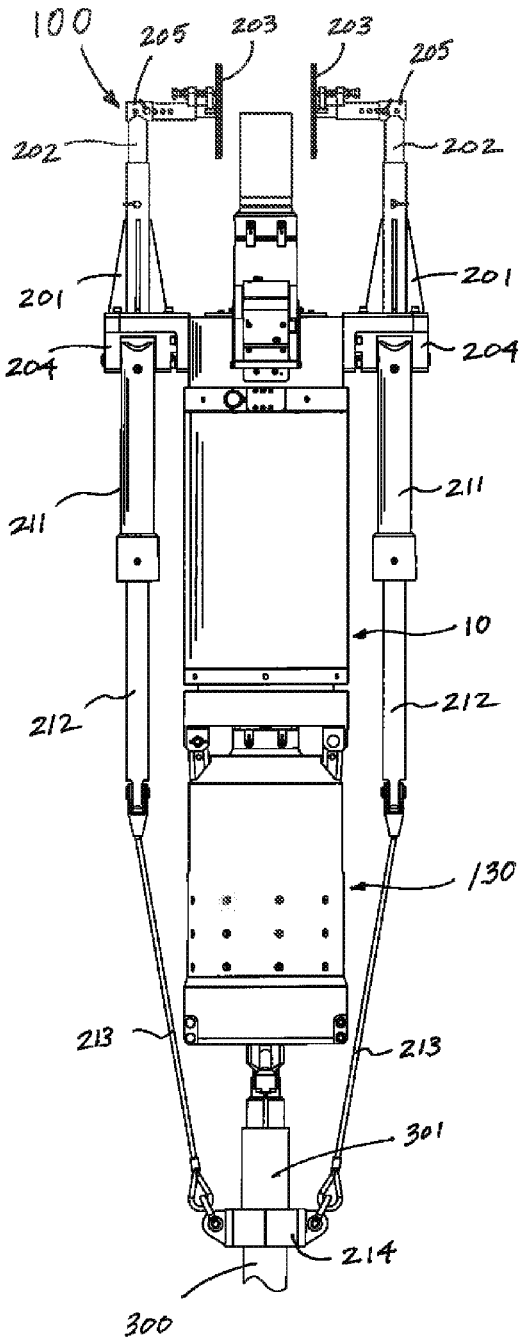
FIG. 1 depicts the modular pipe running assembly of the present invention configured for gripping against the external surface of a section of pipe.
Figure 2:
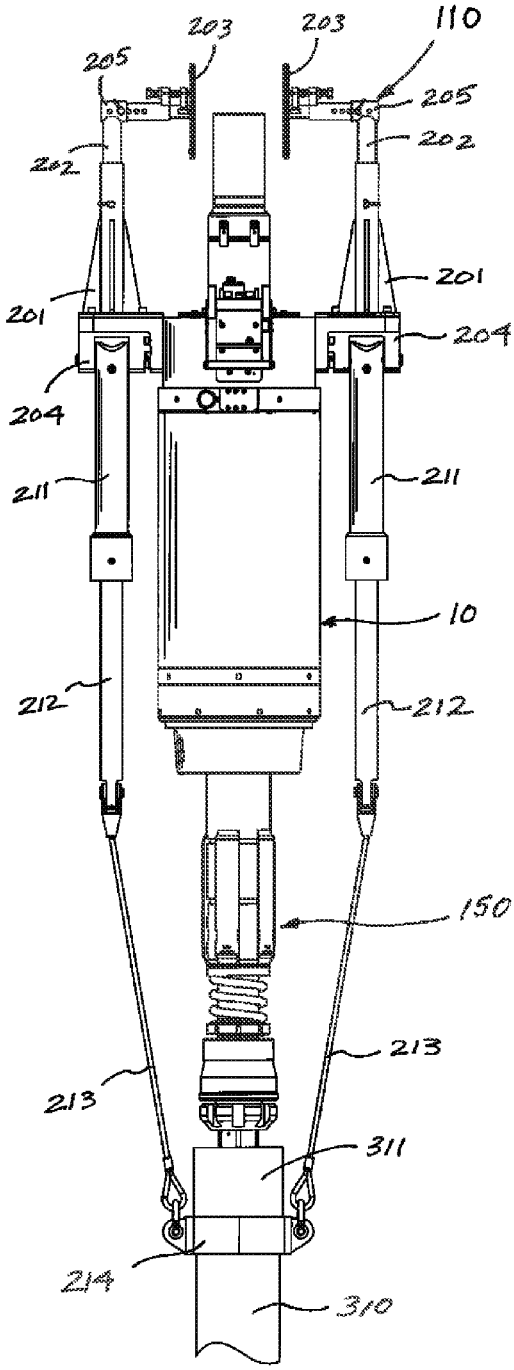
FIG. 2 depicts the modular pipe running assembly of the present invention configured for gripping against the internal surface of a section of pipe.

Referring to the drawings, FIG. 1 depicts modular pipe running assembly 100 of the present invention configured for gripping against the external surface of a length of pipe. FIG. 2 depicts alternative embodiment modular pipe running assembly 110 of the present invention configured for gripping against the internal surface of a length of pipe.

As depicted in FIG. 1, modular pipe running assembly 100 can be connected beneath a rig's existing top drive assembly, and generally comprises axially aligned modular actuator assembly 10 and external pipe gripping assembly 130. In the embodiment depicted in FIG. 2, modular pipe running assembly 110 comprises many of the same components as modular pipe running assembly 100 depicted in FIG. 1, except that internal pipe gripping assembly 150 is connected to actuator assembly 1, rather than external pipe gripping assembly 130.

Referring to FIG. 1, in the preferred embodiment modular pipe gripping assembly 100 has an adjustable mounting assembly for connecting an optional stabbing assembly to said modular pipe gripping assembly 100. It is to be observed that the size, shape and specific configuration of said adjustable mounting assembly can vary depending upon a number of variables including, without limitation, top drive design; however, as depicted in FIG. 1, said adjustable mounting assembly generally comprises bilateral base members 201 surmounted on clevis bracket members 204 which are attached to modular pipe running assembly 100. Adjustable bilateral arm members 202 are telescopically and adjustably disposed within said base members 201 and have angle members 205 that permit the angle of said arm members 202 to be adjusted, as well as bilateral interference plates 203 that can be beneficially positioned in proximity to a rig's top drive assembly.

Still referring to FIG. 1, optional stabbing assembly comprises bilateral cylinder barrels 211 pivotally connected to bracket members 204. Piston rods 212 are telescopically disposed in said cylinder barrels 211, and can be extended or retracted using hydraulic, pneumatic or other power source well known to those having skill in the art. Connecting cables 213 extend from said cylinder piston rods 212 to single-joint pipe elevators 214. As depicted in FIG. 1, elevators 214 are used to grip pipe section 300 having upper connection collar, which can be a joint of casing or other tubular good, in a manner well known to those having skill in the art.

Referring to FIG. 2, in the preferred embodiment modular pipe gripping assembly 110 is also equipped with an adjustable mounting assembly for connecting an optional stabbing assembly to said modular pipe gripping assembly 110. Said adjustable mounting assembly and stabbing assembly have substantially the same components as depicted in FIG. 1, and can likewise be used to grip a length of pipe, such as pipe section 310 having upper connection collar 311.

Figure 3:
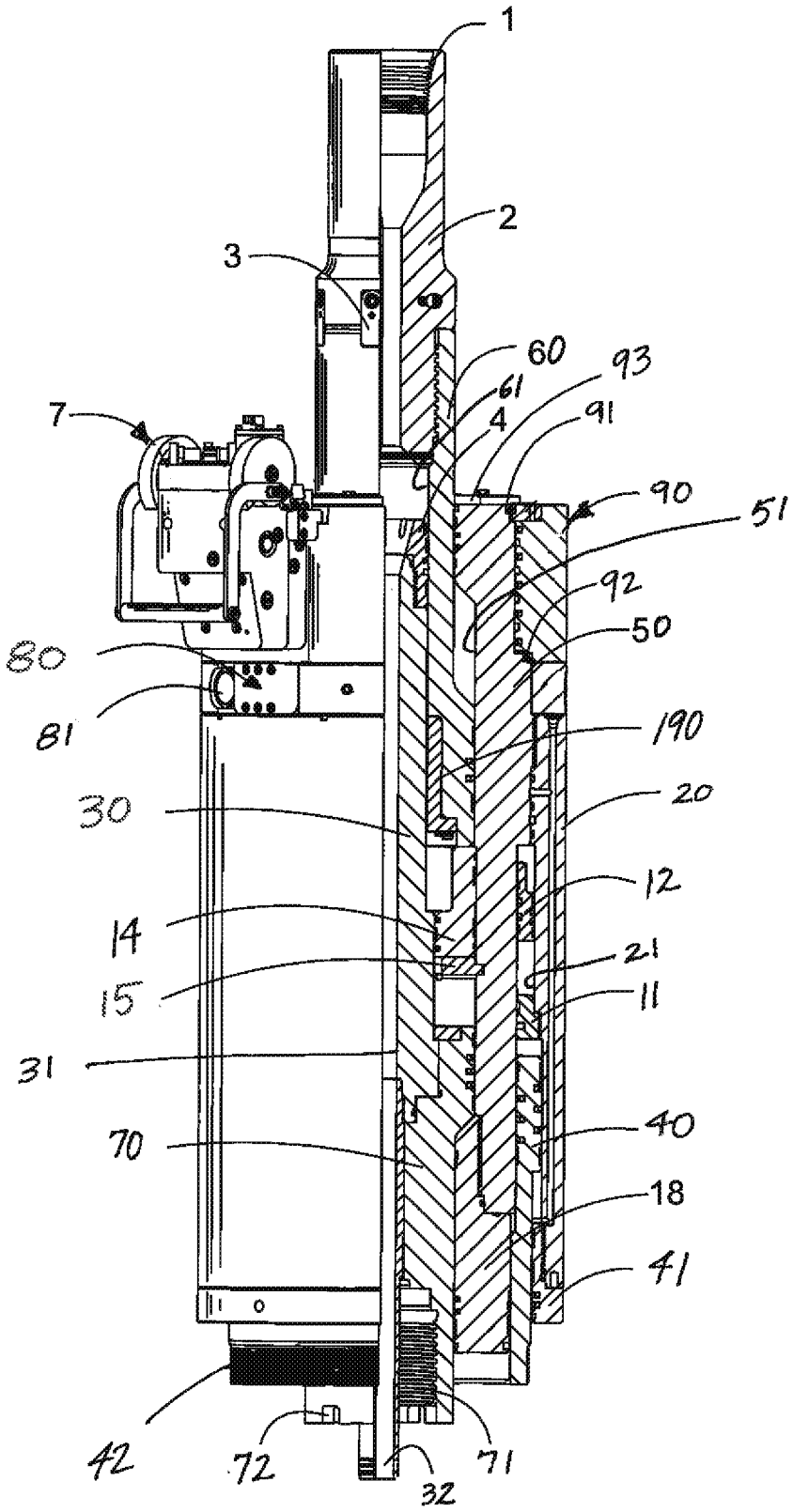
FIG. 3 depicts a side partial sectional view of a modular actuator assembly of the present invention.

FIG. 3 depicts a side sectional view of an actuator assembly 10 of the present invention equipped with a weight compensator assembly to provide weight compensation as described more fully herein. As noted above, said actuator assembly 10 can be used as a component of either modular pipe running assembly 100 depicted in FIG. 1, or alternative embodiment modular pipe running assembly 110 depicted in FIG. 2. Further, as depicted in FIG. 3, said actuator assembly 10 is equipped with a weight compensator which is frequently beneficial during pipe assembly and installation operations. Generally, said weight compensator assembly is used to compensate for the weight of a top drive unit, pipe running assembly and/or pipe weight, particularly during pipe connection (make-up) operations; it is generally beneficial to remove excessive weight from a section of pipe during the thread run when such pipe is being threadedly connected to another section or string of pipe.

Still referring to FIG. 3, crossover 2 has upper threaded connection 1 that provides an interface for connecting actuator assembly 10 of a modular pipe running assembly to a top drive quill. If required, crossover 2 can be easily changed so that upper threaded connection 1 can mate with virtually any top drive quill or other configuration. Torque locking tabs 3 permit crossover 2 to be easily made up, while allowing for transmission of torque from a top drive to said modular pipe running assembly in a manner generally described herein.

Actuator assembly 10 comprises central body member 50 having central axial through bore 51. Compensator piston 60 is connected to crossover 2, and is movably disposed within said central through bore 51 of central body member 50. Compensator piston 60 is disposed within said through bore 51 of central body member. Said compensator piston 60 has central axial bore 61 with spline coupling 190 disposed therein.

Drive shaft 30, itself having central axial through bore 31, is disposed within said central axial bore 61 of compensator piston 60. Drive shaft 30 is also disposed through sealed divider piston 14 and mandrel piston 70 (having lower threads 71 and torque locking tab recesses 72). Sealed divider retention ring 15 retains sealed divider piston 14. Mud seal block 4 is connected to the upper end of drive shaft 30.

Outer actuator sleeve 20 has inner bore 21 which, together with body member 50, defines annular spaces between said outer actuator sleeve 20 and body member 50. Accumulator piston 12, ported divider piston 11 and external actuator piston 40, having external threads 42, are disposed within said bore 21 of outer actuator sleeve 20. Lower gland member 18 is connected to the base of body member 50. Lower tubular member 32 is connected to drive shaft 30 and extends through a central bore in mandrel piston 70. External actuator piston gland 41 is disposed below said external actuator piston 40.

Body member 50 is rotatably disposed within swivel sleeve assembly 90. Quick connect/disconnect control manifold assembly 7 quickly connects to (and disconnects from) swivel sleeve assembly 90, and can transmit hydraulic fluid to actuator assembly 10 in order to control operation of said actuator assembly 10. Check valve manifold assembly 80 having pilot-operated check valve 81 is sealably connected to body member 50. Upper fluid seal member 91 and lower fluid seal member 92 are disposed above and below swivel sleeve assembly 90; retention plate 93 is also disposed on said swivel sleeve assembly 90.

Figure 4:
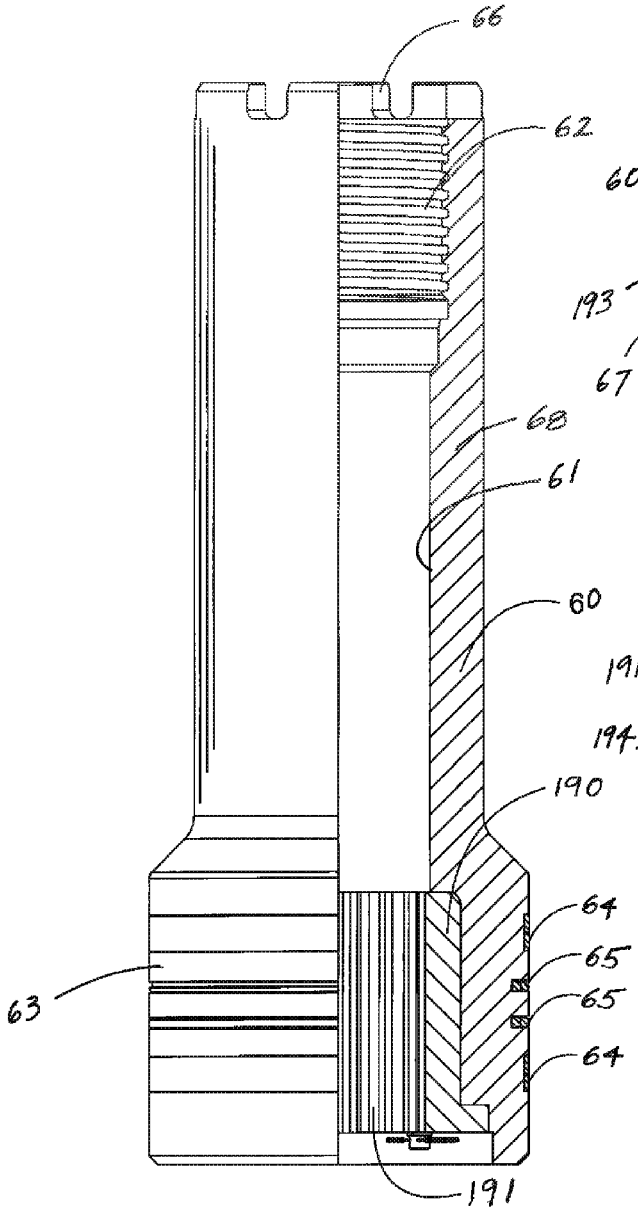
FIG. 4 depicts a side partial sectional view of a compensator piston and spline coupling of the present invention.

FIG. 4 depicts a side, partial sectional view of compensator piston 60 and spline coupling 190 of the present invention. Compensator piston 60 has substantially tubular body section 68 having central through bore 61. Compensator piston 60 comprises upper threaded connection 62 for connection to a crossover (such as crossover 2 depicted in FIG. 3), as well as lower receptacle section 63; in the preferred embodiment, said lower receptacle section 63 has a larger diameter than body section 68. Compensator piston 60 further has at least one notch or recess 66 at its upper end for receiving a corresponding torque locking tab (such as from crossover 2 depicted in FIG. 1 not shown in FIG. 4). In the preferred embodiment, substantially parallel channels 64 and sealing elements 65 are disposed around the outer circumferential surface of lower receptacle section 63. In the preferred embodiment, said sealing elements 65 comprise elastomeric seals. Spline coupling 190 having internal spline profile 191 is disposed within lower receptacle 63.

Figure 6:
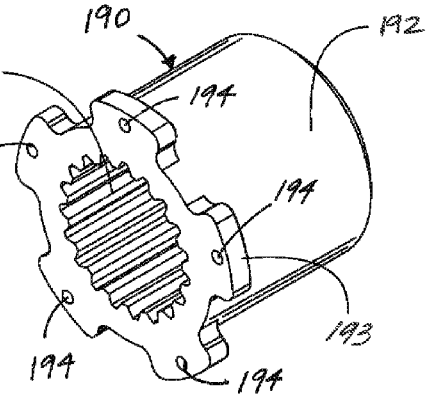
FIG. 6 depicts a side perspective view of a spline coupling member of the present invention.

FIG. 6 depicts a side perspective view of spline coupling 190 of the present invention. In the preferred embodiment, said spline coupling 190 has cylindrical body section 192 having internal spline profile 191. A plurality of flange-like projections 193 extend radially outward from body member 192. In the preferred embodiment, said projections 193 have substantially rounded edges, and bores 194 extending through said projections.

Figure 5:
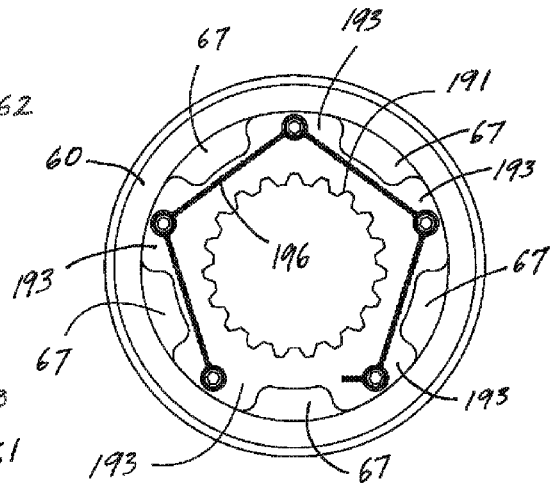
FIG. 5 depicts a bottom view of the compensator piston and spline coupling of the present invention depicted in FIG. 4.

FIG. 5 depicts a bottom view of compensator piston 60 and spline coupling 190 of the present invention depicted in FIG. 6. Said spline coupling 190, having internal spline profile 191, is received within lower receptacle section 63 of compensator piston 60. Flange-like radial projections 193 fit between and mate with corresponding finger members 67 extending inward from the inner surface of lower receptacle section 63 of compensator piston 60. In the preferred embodiment, projections 193 are shaped to fit between said finger members 67; engagement of said projections 193 and finger members 67 permits the transmission of torque between spline coupling 190 and compensator piston 60. Anchor bolts 195 secure spline coupling 190 within compensator piston 60, and said anchor bolts can be joined by optional retention cable 196.

Figure 7:
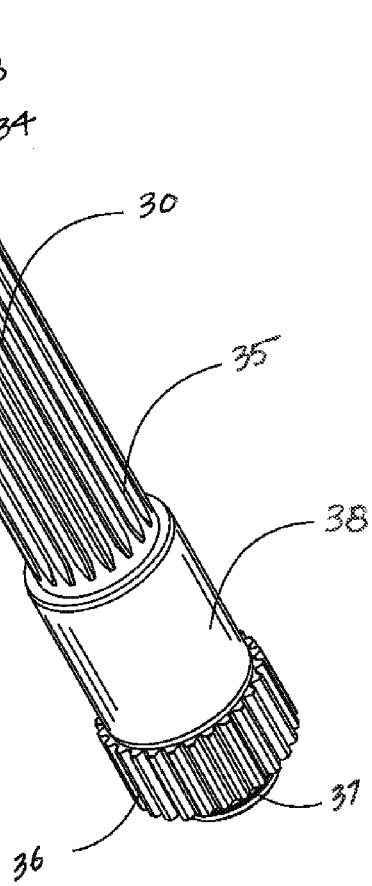
FIG. 7 depicts a side perspective view of a drive shaft of the present invention.

FIG. 7 depicts a side perspective view of drive shaft 30 of the present invention. Drive shaft 30 has central axial through bore 31, upper sealing element 33 and upper threaded connection 34, upper external spline profile 35, lower external spline profile 36 and lower sealing element 37. Body section 38, having a substantially smooth outer surface, is disposed between said upper external spline profile 35 and lower external spline profile 36. In the preferred embodiment, upper sealing element 33 and lower sealing element 37 comprise elastomeric seals.

Figure 8:
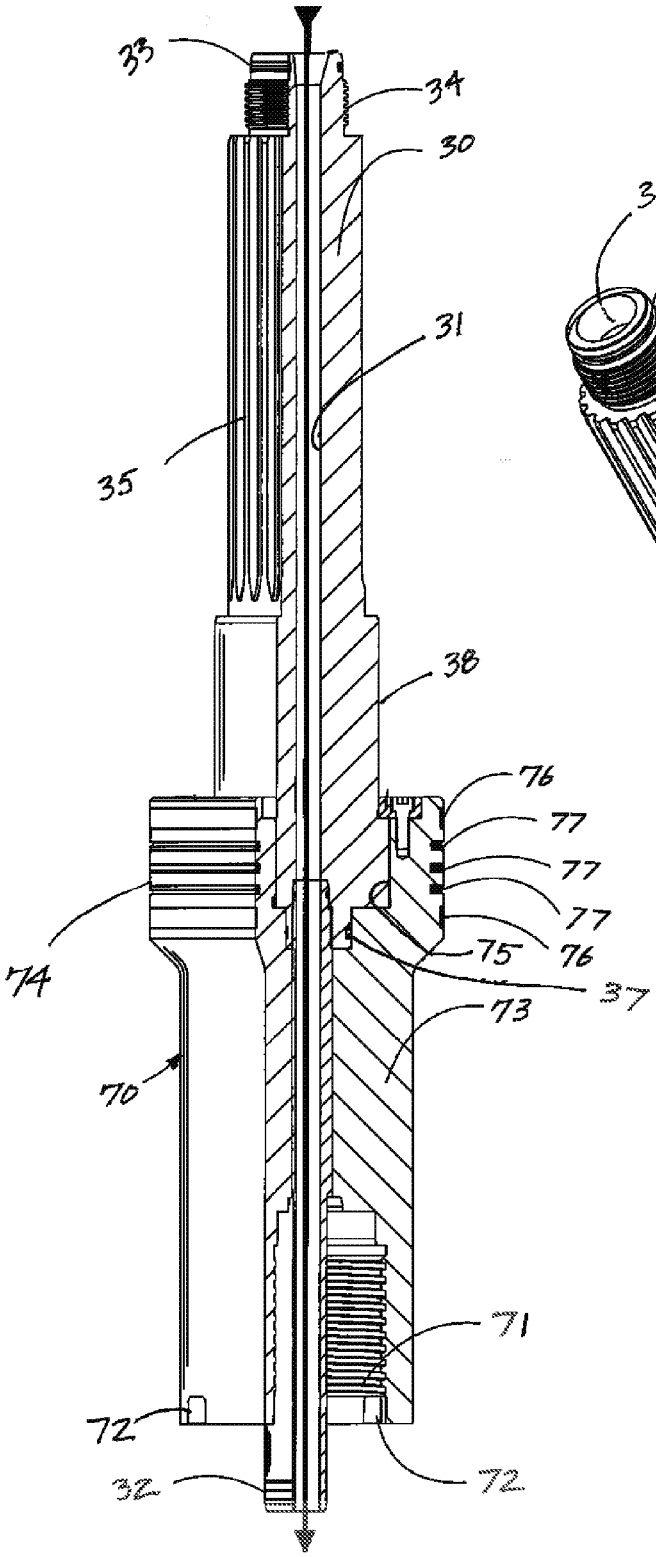
FIG. 8 depicts a side partial sectional view of a drive shaft and mandrel piston of the present invention.

FIG. 8 depicts a side, partial sectional view of drive shaft 30 mated with mandrel piston 70 of the pipe running assembly of the present invention. Drive shaft 30 has central axial through bore 31, upper sealing element 33, upper threaded connection 34 and upper external spline profile 35, and is partially received within mandrel piston 70.

Mandrel piston 70 has cylindrical body section 73 defining a substantially smooth outer surface. Upper receptacle section 74 has central bore 75 having an inner spline profile (not visible in FIG. 8). In the preferred embodiment, substantially parallel channels 76 and sealing elements 77 are disposed around the outer circumferential surface of upper receptacle section 74. In the preferred embodiment, said sealing elements 77 comprise elastomeric seals. Mandrel piston 70 also has lower threads 71 and torque locking tab recesses 72.

Still referring to FIG. 8, drive shaft 30 is partially received with bore 75 of mandrel piston 70. Lower external spline profile 36 of drive shaft 30 mates with inner spline profile of bore 75, thereby facilitating the transfer of torque between said drive shaft 30 and mandrel piston 70. Lower sealing element 37 of drive shaft 30 seals against an inner surface of mandrel piston 70, thereby creating a fluid pressure seal.

Figure 9:
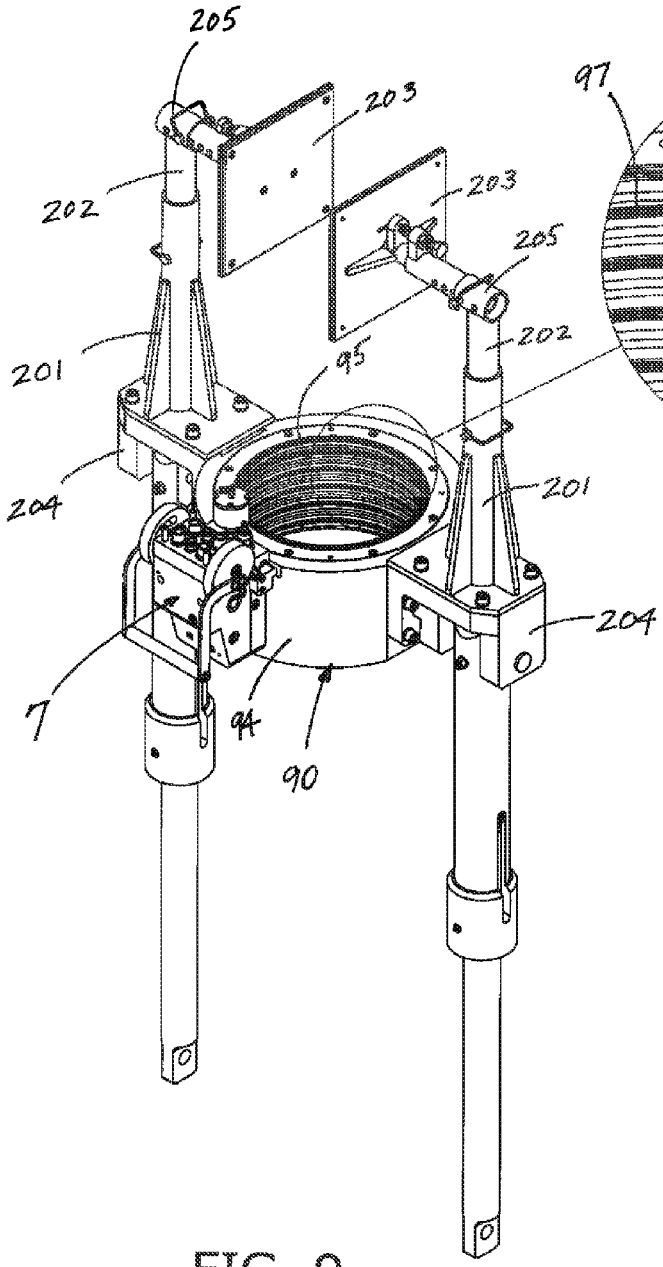
FIG. 9 depicts a side perspective view of components of a swivel assembly of the present invention.

FIG. 9 depicts an overhead perspective view of an adjustable mounting assembly and swivel assembly 90 of the present invention. Said adjustable mounting assembly generally comprises bilateral base members 201 surmounted on clevis bracket members 204. Adjustable bilateral arm members 202 are telescopically disposed within said base members 201 and have angle members 205, as well as bilateral interference plates 203 that can be beneficially positioned in proximity to a rig's top drive assembly.

Swivel assembly 90 generally comprises body member 94 defining central through bore 95. In the preferred embodiment, quick connect control fluid manifold assembly 7 is attached to said swivel body member 94. Although not depicted in FIG. 9, central body member 50 of actuator assembly 10 can be rotatably received within central bore 95 of swivel body member 94.

Figure 10:
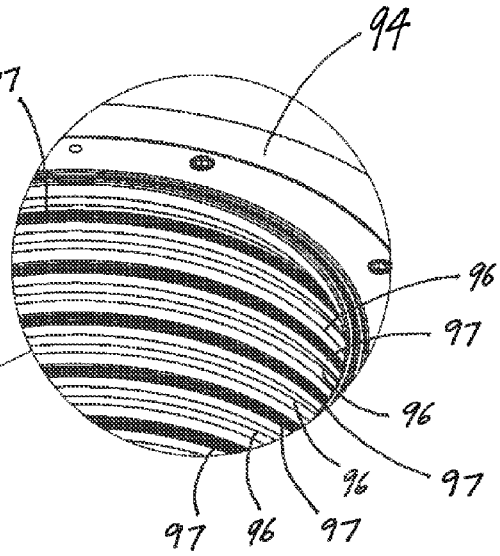
FIG. 10 depicts a detailed view of fluid channels and seals of the swivel assembly components of the present invention depicted in FIG. 9.

FIG. 10 depicts a detailed view of a portion of swivel assembly 90 depicted in FIG. 9. A plurality of stacked channels 96 are disposed along the inner surface of swivel body member 94 that is defined by central bore 95. Fluid sealing elements 97 are disposed between each of said channels 96. In the preferred embodiment, said fluid sealing elements 97 comprise elastomeric seals.

Although not depicted in FIGS. 9 and 9*a*, a plurality of fluid channels are also disposed within body member 50 of actuator assembly 10 which is rotatably disposed in bore 95 of body member 94. At least one fluid channel in said body member 50 corresponds with an aligned fluid channel 96 of swivel assembly 90. As such, control fluid (for example, hydraulic oil) can be supplied to quick connect manifold assembly 7 from an external or remote fluid source. Such fluid can be pumped through said quick connect manifold assembly 7, through bore(s) extending through swivel body member 94, into a desired channel 96 in said swivel body member 94, and into a corresponding fluid channel in body member 50 of actuator assembly. Importantly, although said swivel body member 94 does not rotate, actuator assembly body member 50 is capable of rotation within bore 95 of body member 94 of swivel assembly 90, yet control fluid can be pumped from said remote location through swivel assembly into actuator assembly 10 to control functioning of the pipe running assembly of the present invention.

Figure 11:
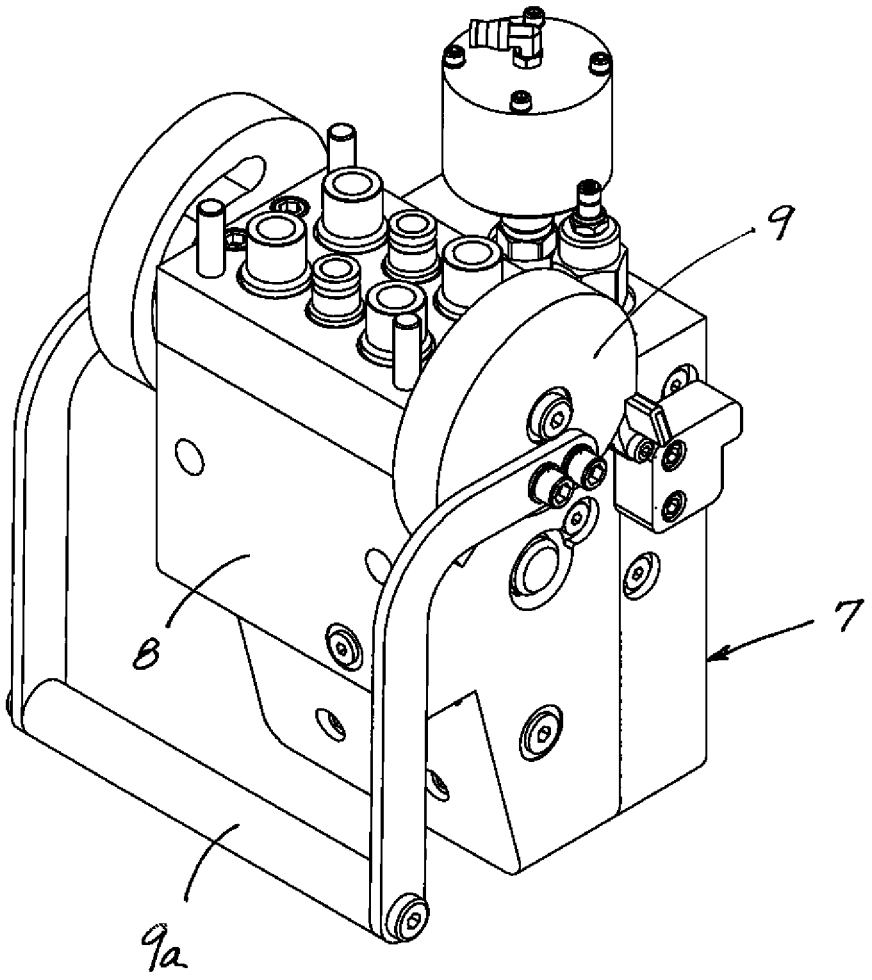
FIG. 11 depicts a side, partial sectional view of a control fluid manifold of the present invention.

FIG. 11 depicts a side perspective view of quick connect manifold 7 of the present invention. Although manifold 7 can have many different configurations, in the preferred embodiment said manifold 7 comprises body section 8. Locking mechanism 9 having handle 9*a* provides a means for quickly attaching said manifold 7 to swivel assembly 90. Said manifold 7 also comprises various valves, described in more detail herein, as well as ports for connection to control fluid lines. In the preferred embodiment, said lines supply hydraulic oil to manifold 7 from a remote fluid source.

Figure 12:
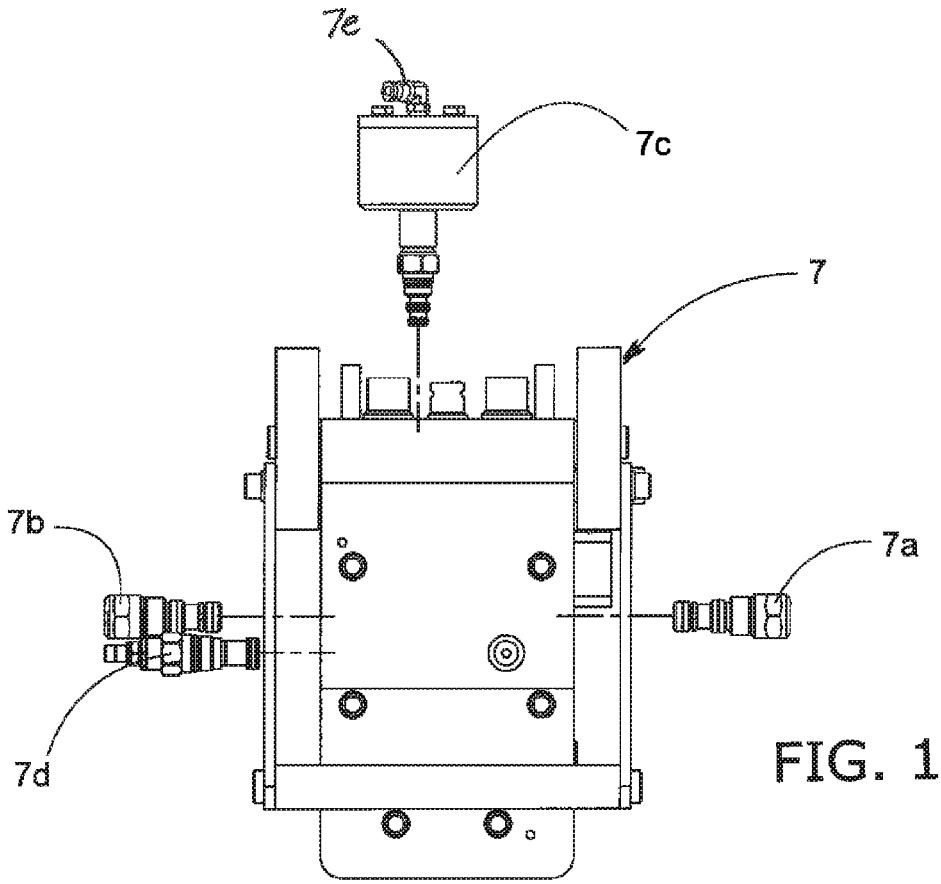
FIG. 12 depicts a rear view of a control fluid manifold of the present invention.
Figure 13:
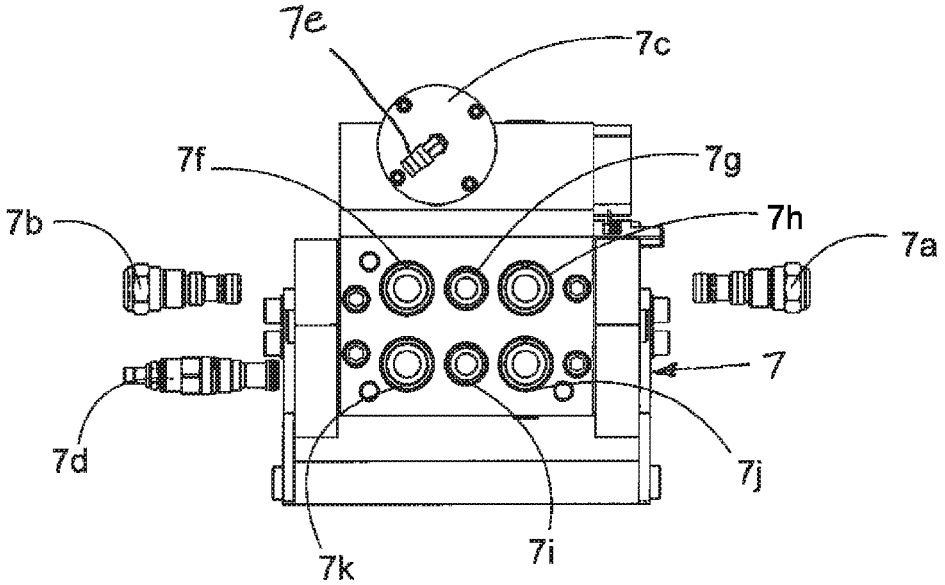
FIG. 13 depicts a top view of a control fluid manifold of the present invention.

FIG. 12 depicts a rear view of manifold 7 of the present invention, while FIG. 13 depicts a top view of said manifold 7. In the preferred embodiment, said manifold 7 comprises hydraulic pressure reducing valve 7*a*, hydraulic relief valve 7*b*, air piloted 2-way hydraulic valve 7*c*, hydraulic kick down relief valve 7*d*, air pilot line 7*e* for air piloted valve 7*c*, pressure input 7*f* to pressure reducing valve, pilot control line 7*g* for sampling pressure acting on compensator piston of actuator assembly, return line 7*h* for pressure relief valve 7*b*, pilot line 7*i* to release pilot operated check valve 81 (not shown in FIG. 12 or 13) once valve 7*c* is opened by air pilot signal, slip set signal line 7*k* and slip release signal line 7*j*.

Figure 14:
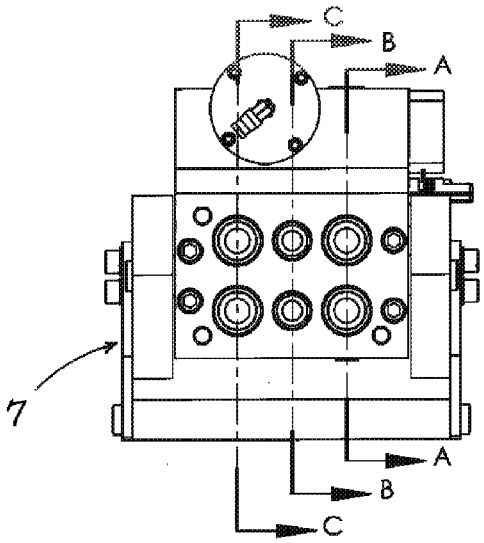
FIG. 14 depicts an overhead view of a control fluid manifold of the present invention.
Figure 16:
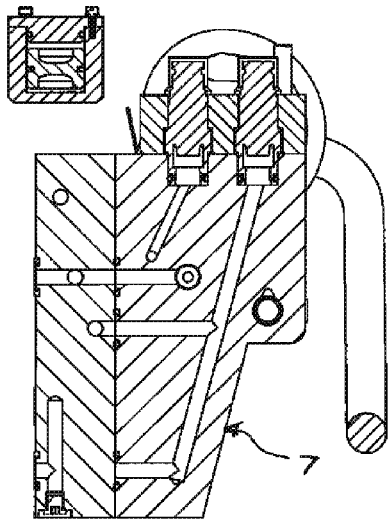
FIG. 16 depicts a sectional view of a control fluid manifold of the present invention along line B-B of FIG. 14.
Figure 15:
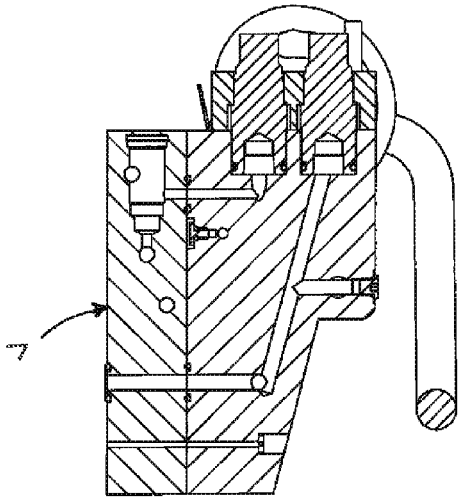
FIG. 15 depicts a sectional view of a control fluid manifold of the present invention along line A-A of FIG. 14.
Figure 17:
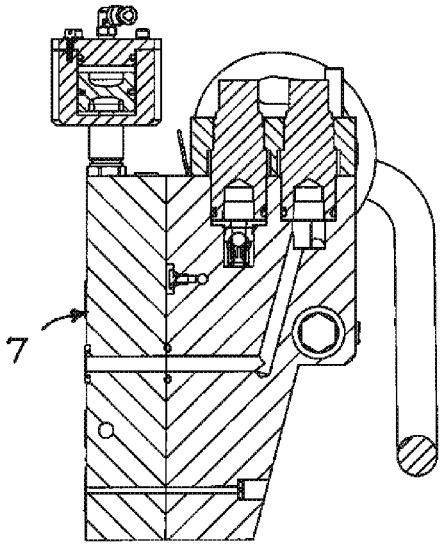
FIG. 17 depicts a sectional view of a control manifold of the present invention along line C-C of FIG. 14.

FIG. 14 depicts an overhead view of manifold assembly 7 of the present invention. FIG. 15 depicts a sectional view of manifold 7 of the present invention along line A-A of FIG. 14. FIG. 16 depicts a sectional view of manifold 7 of the present invention along line B-B of FIG. 14. FIG. 17 depicts a sectional view of manifold 7 of the present invention along line C-C of FIG. 14.

Figure 18:
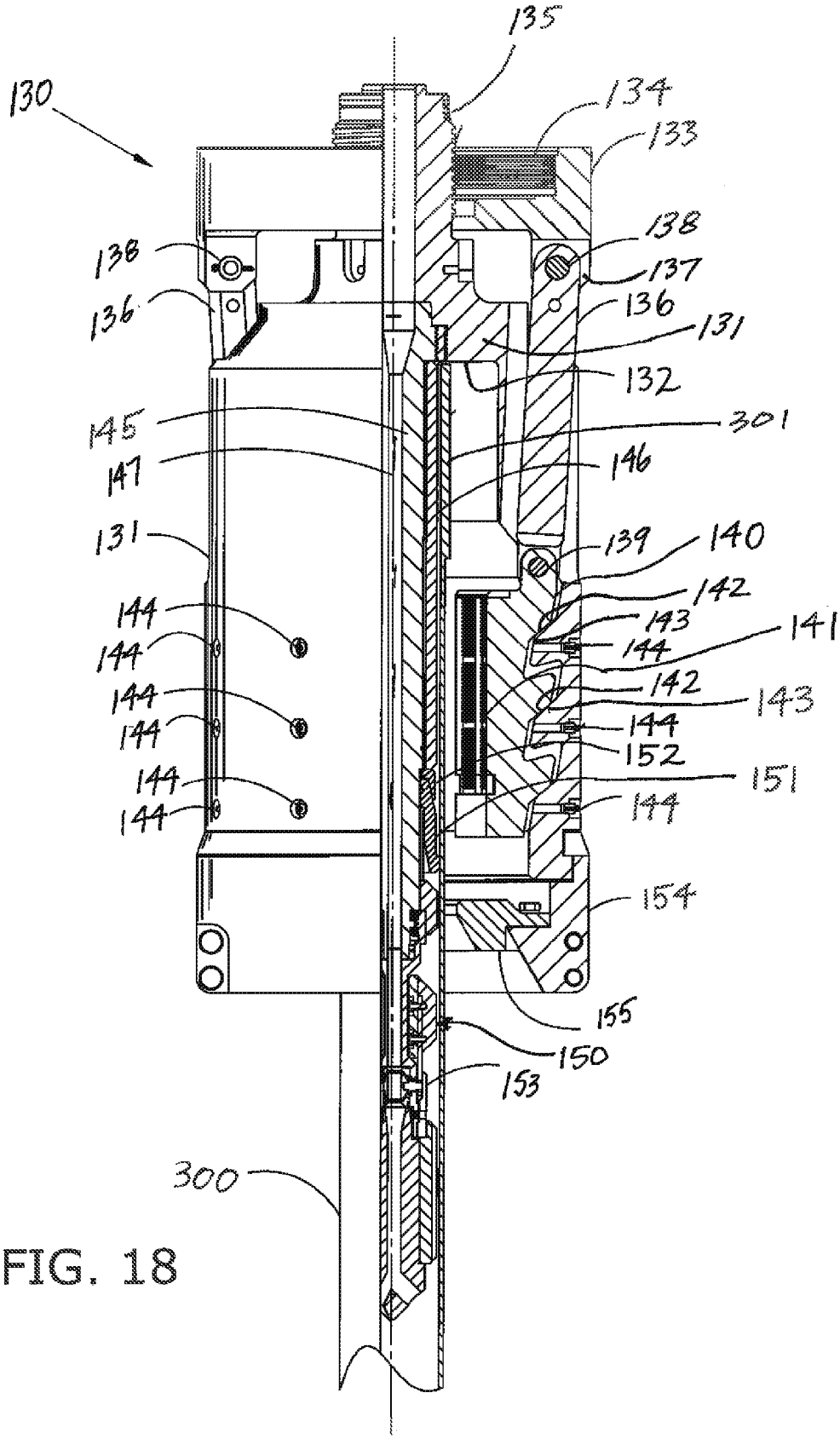
FIG. 18 depicts a side partial sectional view of an external pipe gripping assembly of the present invention.

FIG. 18 depicts a side, partial sectional view of external pipe gripping assembly 130 of the present invention. External pipe gripping assembly 130 comprises slip bowl body member 131 defining lower surface 132. External pipe gripping assembly 130 further comprises upper push plate 133 having threads 134. Said threads 134 are adapted to mate with threads 42 on external actuator piston 40 of an actuator assembly (such as actuator assembly 10 depicted in FIG. 3) when the pipe gripper of the present invention is configured in the external pipe gripping mode. Slip bowl member 131 further comprises threaded section 135 that extends through a bore in upper push plate 133. Threads 135 are adapted to mate with lower threads 71 of mandrel piston 70 of an actuator assembly (such as actuator assembly 10 depicted in FIG. 3).

Slip bars 136 are pivotally mounted at their upper end to push plate 133 with clevis mounts 137 using upper pivot pins 138. Said slip bars 136 are pivotally mounted at their lower end to slip body 140 using lower pivot pins 139. Slip body 140 has tapered shoulders 142 and slip dies 141 or other gripping means disposed on the inner surface of said slip body 140. Said slip body 140 is movably disposed on inner tapered surfaces 143 of slip bowl 131, which provide support surfaces for tapered shoulders 142 of slip body 140. Grease ports 144 extend through slip bowl member 131, and provide a path for supplying lubricant to opposing tapered surfaces 142 and 143. Bottom bell extends from the bottom of pipe gripping assembly 130, and has tapered guide 155 to guide or direct said pipe gripping assembly 130 over the upper end of a section of pipe (such as pipe section 300).

Arbor member 145 having outer sleeve 146 and inner through-bore 147 extends through slip bowl member 131 and connects to a fluid fill-up tool assembly 150. Said fluid fill-up assembly 150 is well known to those having skill in the art. Said fluid fill-up tool assembly 150, which has elastomeric sealing cup 151 and cup ring 152, can extend into the bore of a section of pipe 300 having connection collar member 301 that is gripped by external pipe gripping assembly 130. When said fluid fill-up tool is inserted into the upper end of a section of pipe (such as pipe section 300), valve assembly 153 is opened to allow fluid flow through said fluid fill-up tool. However, when said fluid fill-up tool assembly 150 is removed from a section of pipe, said valve assembly 153 closes, thereby preventing drilling mud or other fluid from spilling out of or otherwise flowing from the bottom of a pipe running assembly of the present invention.

Figure 19:
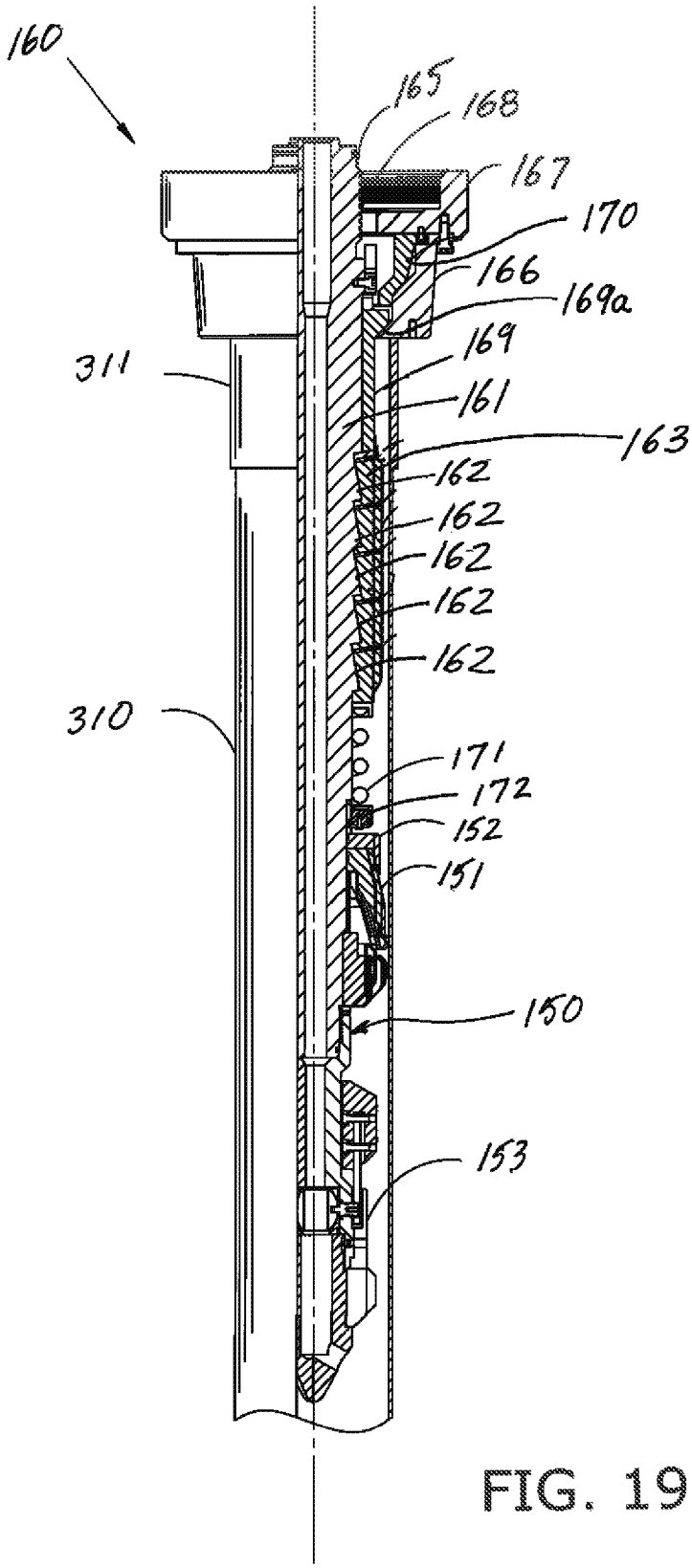
FIG. 19 depicts a side partial sectional view of an internal pipe gripping assembly of the present invention.

FIG. 19 depicts a side, partial sectional view of an internal gripping assembly 160 of the present invention. Internal gripping assembly 160 comprises internal mandrel 161 having tapered shoulder surfaces 162 and external threaded section 165. Said internal mandrel 161 is disposed through bump plate 166 having upper connection 167 member with internal threads 168. When incorporated in the pipe running assembly of the present invention, said threads 168 are adapted to mate with threads 42 on external actuator piston 40 of an actuator assembly (such as actuator assembly 10 depicted in FIG. 3), while threads 165 are adapted to mate with lower threads 71 of mandrel piston 70 of an actuator assembly (such as actuator assembly 10 depicted in FIG. 3).

Slip die member 163 having a plurality of outwardly facing pipe gripping dies or other frictional gripping means is movably disposed on tapered shoulder surfaces 162 of mandrel 161. Casing push bar 169 having loading shoulder 169*a* extends from slip die member 163 to spacer member 170. Compression spring 171 is mounted below movable slip die member 163 on adjustable base 172. Adjustable base 172 can be moved to adjust the loading on said compression spring 171.

A fluid fill-up assembly 150, well known to those having skill in the art, has elastomeric sealing cup 151 and cup ring 152, can extend into the bore of a section of pipe 310 having connection collar member 311 that is gripped by external pipe gripping assembly 130. When said fluid fill-up tool is inserted into the upper end of a section of pipe (such as pipe section 300), valve assembly 153 is opened to allow fluid flow through said fluid fill-up tool. However, when said fluid fill-up tool assembly 150 is removed from a section of pipe, said valve assembly 153 closes, thereby preventing drilling mud or other fluid from spilling out of or otherwise flowing from the bottom of the pipe running assembly of the present invention.

Figure 20:
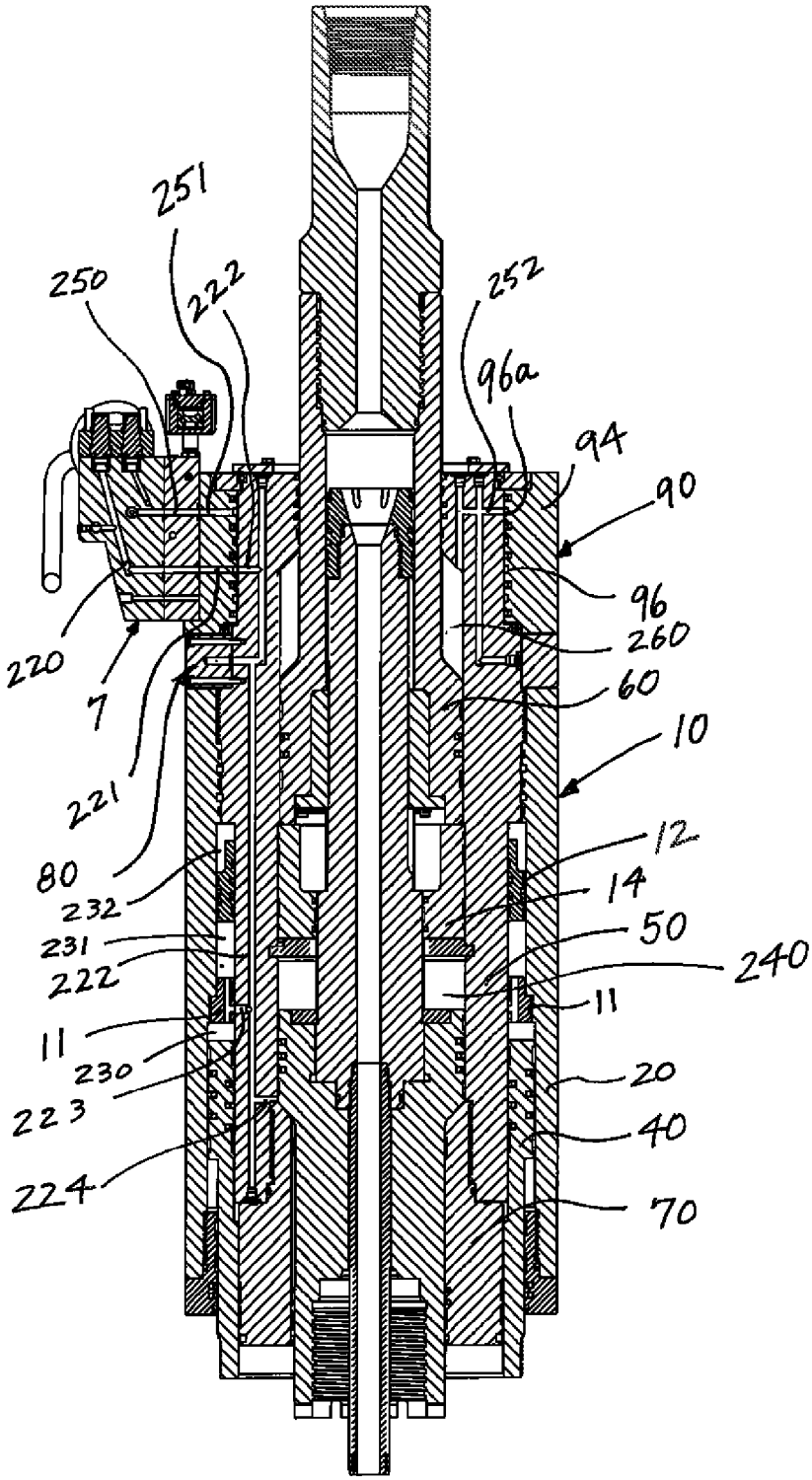
FIG. 20 depicts a side sectional view of actuator assembly of the present invention.
Figure 21:
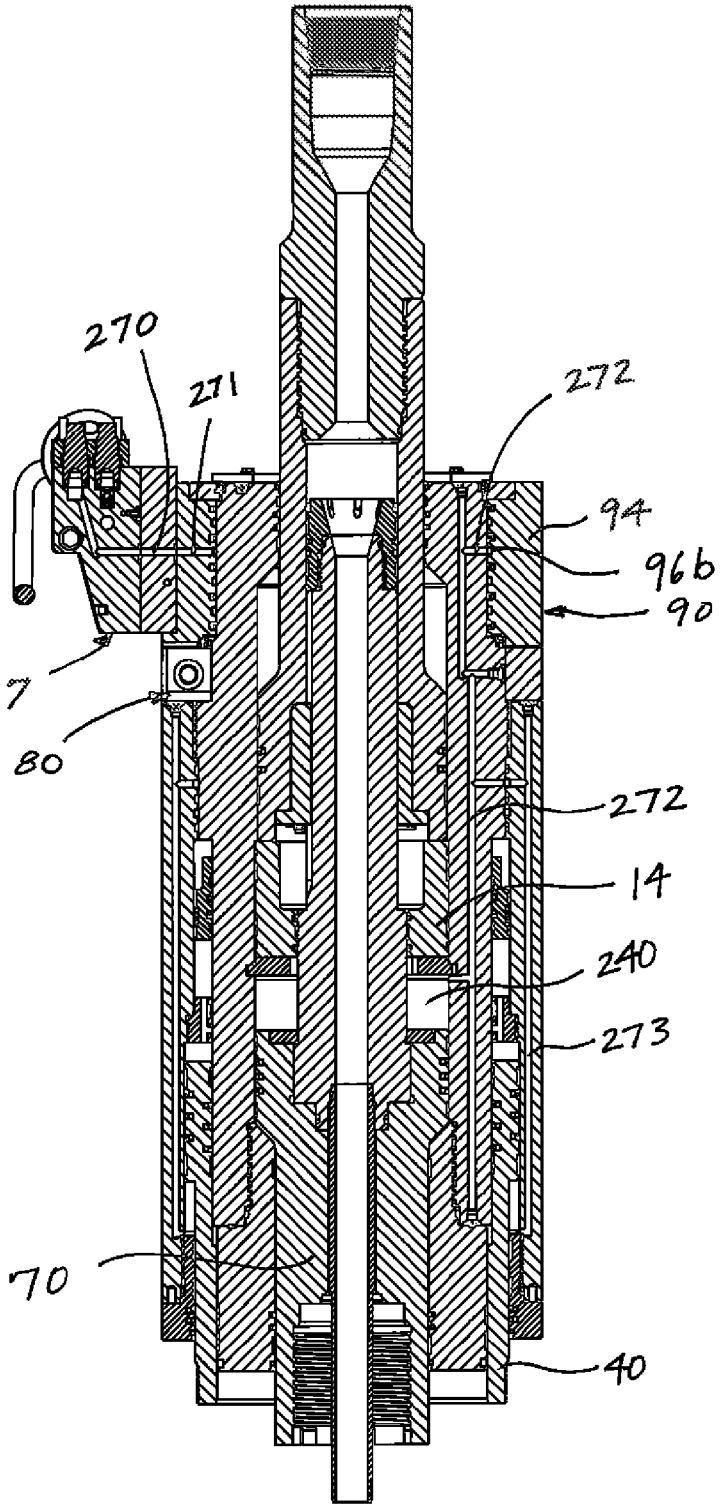
FIG. 21 depicts an alternate side sectional view of actuator assembly of the present invention depicted in FIG. 20.

FIG. 20 depicts a side sectional view of actuator assembly 10 of the present invention, while FIG. 21 depicts an alternate side sectional view of actuator assembly 10 of the present invention depicted in FIG. 20. Referring to FIG. 20, in operation, control fluid (typically hydraulic oil) is supplied to actuator assembly 10 from a remote source, such as a control and pump assembly that can be located on a rig floor or other convenient remote location.

Still referring to FIG. 20, in order to grip a section of pipe, a desired control fluid is supplied to control manifold assembly 7 via hoses or other acceptable means. Said control fluid flows through channel 220 in control manifold assembly 7, and into corresponding fluid channel 221 in body member 94 of swivel assembly 90, which is in turn in communication with an isolated channel 96 of said body member 94. Such fluid within an isolated flow channel 96 then enters aligned fluid channel 222 in body member 50. In this manner, control fluid can be supplied to channel 222 (and other similarly configured channels) in body member 50, even when said body member 50 is capable of rotation relative to swivel assembly 90.

Control fluid flows through fluid channel 222, as well as check valve assembly 80 having a pilot operated check valve 81 (not depicted in FIG. 20) well known to those having skill in the art. When actuated, said pilot operated check valve 81 prevents fluid entering body member 50 through said check valve assembly 80 from flowing back through said check valve assembly 80. After flowing through check valve assembly 80, fluid continues flowing into body member 50 via flow channel 222.

Fluid from flow channel 222 enters channel 223 and flows through a port in accumulator stop ring 11. Said fluid passes through said ported accumulator stop ring 11 and enters annular chambers 230 and 231. Fluid entering chamber 230 provides downward force on external actuator piston 40, causing said external actuator piston 40 to move in a downward direction. Fluid entering chamber 231 acts on accumulator piston 12, thereby compressing gas stored in sealed chamber 232. In this manner, interaction between fluid in chamber 231, accumulator piston 12, and gas in chamber 232 act as a fluid accumulator for storing energy.

When an internal pipe gripping assembly is being used, fluid flows from channel 222 into channel 224 and acts on mandrel piston 70, forcing said piston in an upward direction. However, in the preferred embodiment, when an external pipe gripping assembly is being used, a rigid spacer can be installed within chamber 240 between mandrel piston 70 and sealed divider piston 14, thereby preventing upward movement of said mandrel piston 70.

Similarly, when a weight compensation assembly is being used (such as depicted in the embodiment of actuator assembly 10 depicted in FIGS. 3 and 20), control fluid flows through channel 250 in control manifold assembly 7, and into corresponding fluid channel 221 in body member 94 of swivel assembly 90, which is in turn in communication with an isolated channel 96*a* of said body member 94. Such fluid then enters aligned fluid channel 252 in body member 50. In this manner, control fluid can be supplied to channel 252 (and other similarly configured channels) in body member 50, even when said body member 50 is capable of rotation relative to swivel assembly 90.

Control fluid flows through fluid channel 252 and through check valve assembly 80 having a pilot operated check valve 81 (not depicted in FIG. 20) well known to those having skill in the art. When actuated, said pilot operated check valve 81 prevents fluid downstream of said check valve assembly 80 from flowing back through said check valve assembly 80. After flowing through check valve assembly 80, fluid continues flowing into body member 50 via flow channel 252. Such control fluid enters compensator chamber 260 formed between compensator piston 260 and body member 50. In the preferred embodiment, said fluid flow in and out of compensator chamber 260 can be controlled to compensate for a predetermined weight value.

FIG. 21 depicts an alternate side sectional view of actuator assembly 10 of the present invention depicted in FIG. 20 illustrating certain control paths for retraction of actuator assembly 10 (such as, for example, when a gripping assembly is to release from a section of pipe). Specifically, control fluid flows through channel 270 in control manifold assembly 7, and into corresponding fluid channel 271 in body member 94 of swivel assembly 90, which is in turn in communication with an aligned isolated channel 96*b* of said body member 94. Such fluid then enters aligned fluid channel 272 in body member 50. In this manner, control fluid can be supplied to channel 272 (and other similarly configured channels) in body member 50, even when said body member 50 is capable of rotation relative to swivel sleeve assembly 90.

Control fluid flows through fluid channel 272 and through check valve assembly 80 having a pilot operated check valve 81 (not depicted in FIG. 20) well known to those having skill in the art. Pilot operated check valve 81 (not depicted in FIG. 21) of check valve assembly 80 is actuated to permit bleed-off control line pressure previously supplied downstream of said check valve. Further, control fluid also flows through channels 272 and 273; such control fluid acts on external actuator piston 40 and forces said piston 40 in an upward direction and mandrel piston 70 in a downward direction. As such, said external actuator piston 40 and mandrel piston 70 move in directions opposite from the actuation directions described in connection with FIG. 20. As noted above, is to be observed that when an external pipe gripping assembly is being used, a rigid spacer installed within chamber 240 between mandrel piston 70 and sealed divider piston 14 prevents movement of said mandrel piston 70.

Figure 22:
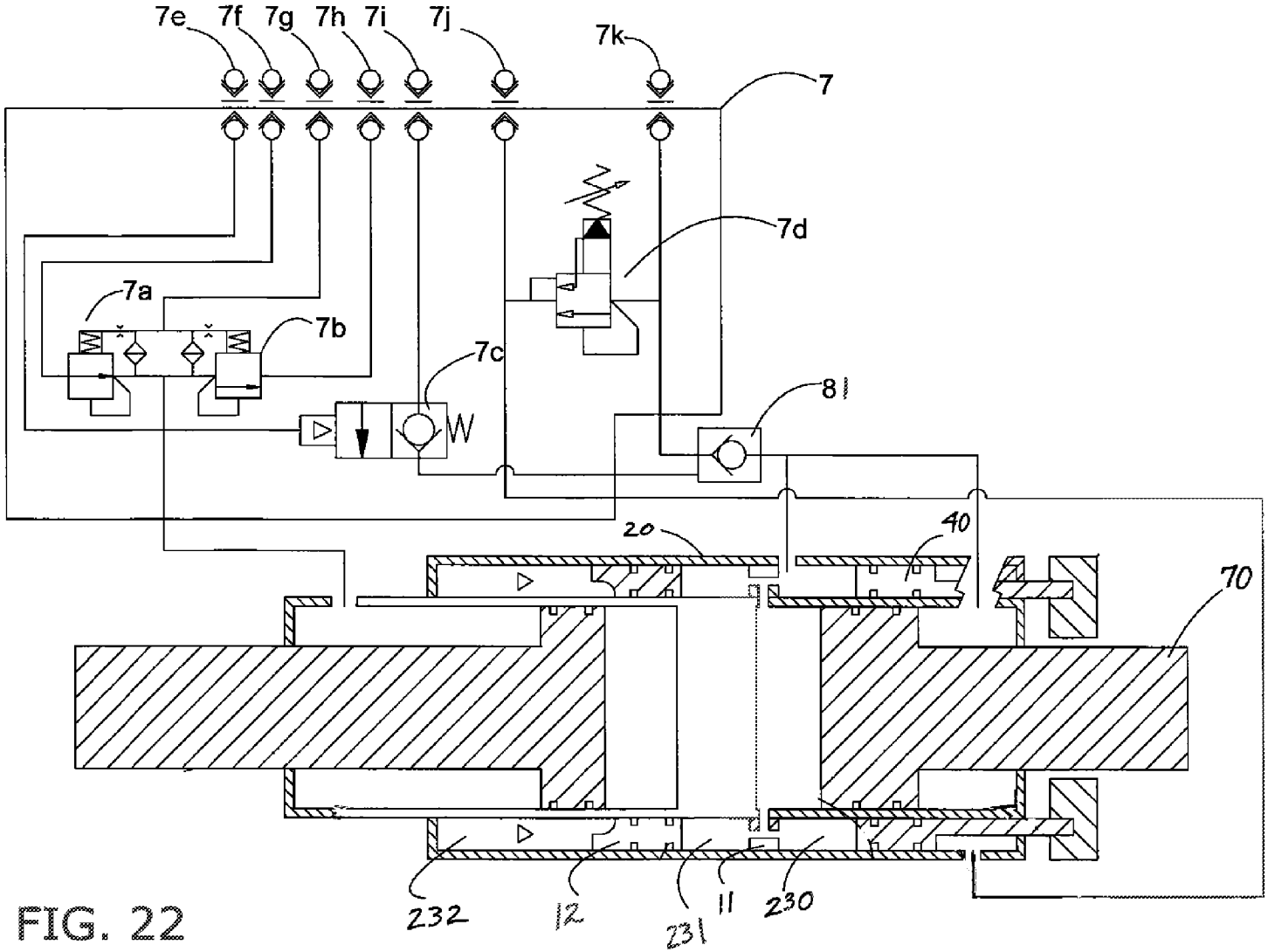
FIG. 22 depicts a schematic view of certain control processes of an actuator assembly of the present invention.

FIG. 22 depicts a schematic view of certain control processes of an actuator assembly of the present invention. A slip set signal can be generated by supplying fluid to line 7*k* of control manifold 7. Said fluid flows through check valve 81 where it is fed into the rod area of mandrel piston 70, causing said mandrel piston 70 to retract. At the same time, fluid is supplied to chamber 230 on the bore side of external actuator piston 40, causing it to extend.

Once the mandrel piston 70 and external actuator piston 40 cause the slips to be set for either a modular internal pipe gripping assembly, or a modular external pipe gripping assembly, fluid fills accumulator chamber 231. When the pressure reaches a predetermined level, kick down relief valve 7*d* opens. The slip set signal 7*k* (fluid) then flows through valve 7*d* and is circulated back to the fluid source/control cabinet (not shown) via 7*j* slip release signal line. At this point, fluid pressure on the bore area of mandrel 70, chamber 230, and accumulator chamber 231 is trapped by check valve 81 once slip set pressure is reached and the system converts to control fluid circulation mode. This pressure is maintained by accumulator piston 12.

Control fluid circulation is maintained at a predetermined pressure that is less than the initial setting pressure. At this pressure the hydraulic sealing elements of a fluid swivel assembly (not shown in FIG. 22), such as sealing elements 97 of swivel assembly 90, relax and are cooled by circulating flow, allowing rotation at higher speeds without damaging said swivel sealing elements.

In order to release slips, when pilot line 7*i* is pressurized through control fluid manifold 7 and swivel assembly 90, it forces pilot operated check 81 to open. Slip release signal 7*j* (fluid) is then permitted to feed the rod side of external actuator piston 40 causing said piston to retract. At the same time, fluid is also supplied to the bore area of mandrel piston 70 causing it to extend. These combined actions cause the slips to release from a gripping engagement with pipe.

Figure 23:
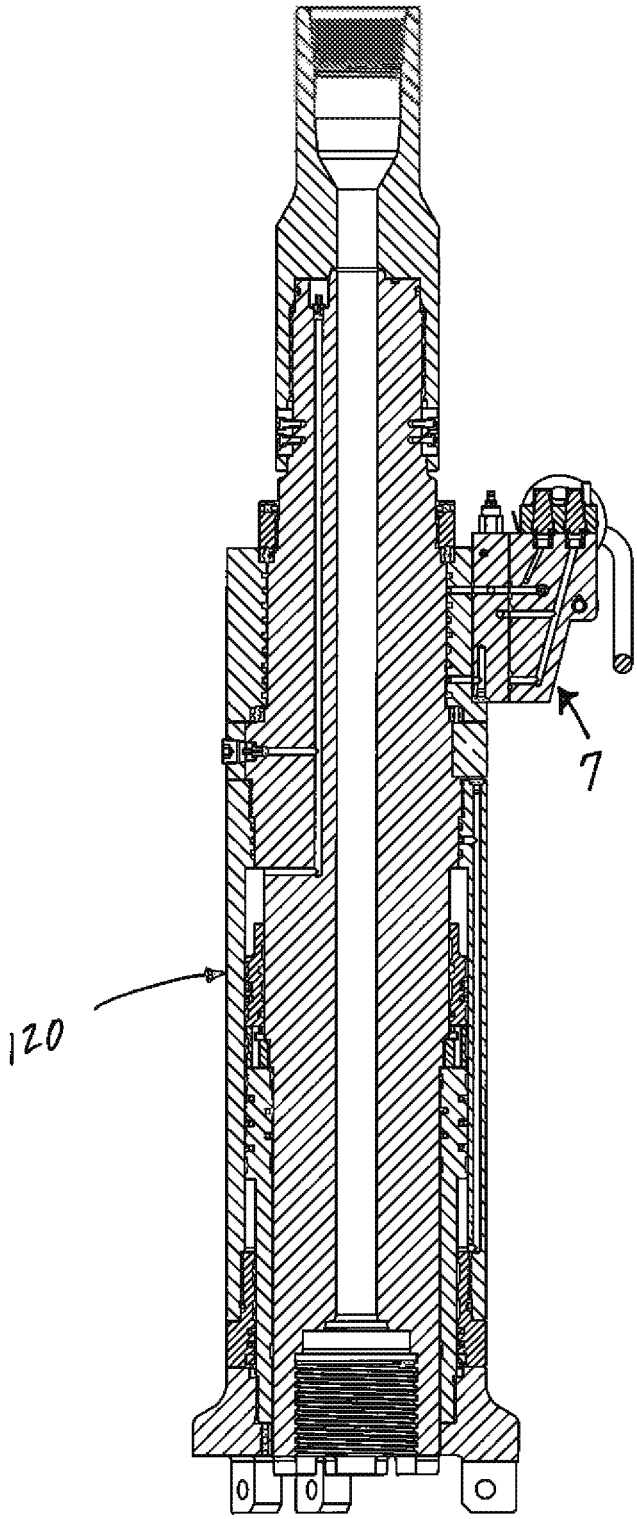
FIG. 23 depicts side sectional view of an alternative embodiment actuator assembly that is not equipped with a weight compensator assembly.

FIG. 23 depicts a side sectional view of an alternative embodiment actuator assembly 120 that, unlike actuator assembly 10 depicted in FIG. 3 is not equipped with a weight compensator assembly. The components of alternative embodiment actuator assembly 120 operate in a manner that is substantially similar to that described in detail herein.

In operation, the pipe running assembly of the present invention can be connected immediately below a rig's top drive unit prior to commencement of casing operations. When gripping of the external surface of pipe is desired, external pipe gripping assembly 130 is attached to actuator assembly 10, generally in the manner depicted in FIG. 1. Alternatively, when gripping of the internal surface of pipe is desired, internal pipe gripping assembly 160 is attached to actuator assembly 10, generally in the manner depicted in FIG. 2.

A single-joint elevator (such as elevator 214 in FIGS. 1 and 2) is typically used to lift individual joints of casing from a V-door or pipe rack into a derrick in vertical alignment over a well. Said top drive assembly and attached pipe running assembly of the present invention are lowered so that any attached fluid fill-up tool (such as fluid fill-up tool 150) is inserted into the bore of the new joint being added. The pipe running assembly can be actuated to grip the new joint of casing, and the top drive is actuated to apply the required torque (through the pipe running assembly of the present invention) to make up the casing to the upper end of a casing string previously installed in the well and supported at the rig floor from lower spider slips. After the new joint of pipe has been made up to the existing string of pipe in the well, said lower spider slips can be released.

When the lower spider slips are released, the entire string of casing is supported by the top drive assembly and pipe running assembly of the present invention. At this point, said pipe can be lowered into said well. During the lowering of the pipe string into the well, the pipe string can be rotated and/or reciprocated, and drilling fluids can be circulated, to facilitate installation of the pipe string in the well.

When gripping of the external surface of pipe is desired, external pipe gripping assembly 130 depicted in FIG. 18 is connected to the bottom of an actuator assembly, such as actuator assembly 10 depicted in FIG. 3, which is in turn mounted to a quill of a top drive assembly. Specifically, threads 135 of slip bowl member 131 are connected to lower threads 71 of mandrel piston 70 of an actuator assembly (such as actuator assembly 10 depicted in FIG. 3), while threads 134 of upper push plate 133 are connected to threads 42 of external actuator piston 40 (such as actuator assembly 10 depicted in FIG. 3). When setting of the actuator assembly and gripping of pipe is desired, control fluid is supplied to actuator assembly 10 from a pump/control console situated in a convenient remote location (such as on a rig floor, for example). Such control fluid is supplied to said actuator assembly through control fluid manifold assembly 7.

When said actuator assembly 10 is actuated as depicted in FIG. 20 and discussed herein, external actuator piston 40 moves in a downward direction. Such downward force by external actuator piston 40 acts on upper push plate 133, forcing slip bars 136 in a downward direction. As slip bars 136 are urged downward, such slip bars 136 impart downward force on slip assembly 140, causing tapered shoulders 142 to ride down inner tapered surfaces 143 of slip bowl member 131 which, in turn, forces gripping dies 141 inward in gripping engagement against the outer surface of pipe section 300. Further, as surface 132 of slip bowl member 131 is lowered, it can contact upper collar member 301 of pipe section 300; any such upward forces imparted by said pipe section 300 on said slip bowl assembly 131 further forces slip assembly 140 inward, increasing the grip on pipe section 300. When release of said gripping assembly from said pipe is desired, the release process of actuation assembly 10 depicted in FIG. 21 is employed.

Similarly, when gripping against the internal surface of pipe is desired, internal pipe gripping assembly 160 depicted in FIG. 19 is connected to the bottom of an actuator assembly (instead of external pipe gripping assembly 130), such as actuator assembly 10 depicted in FIG. 3, which is in turn mounted to a quill of a top drive assembly. Specifically, threads 165 of central mandrel 161 are connected to lower threads 71 of mandrel piston 70 of an actuator assembly (such as actuator assembly 10 depicted in FIG. 3), while threads 168 of upper connection member 167 are connected to threads 42 of external actuator piston 40 (such as actuator assembly 10 depicted in FIG. 3). When setting of the actuator assembly and gripping of pipe is desired, control fluid is supplied to actuator assembly 10 from a pump/control console situated in a convenient remote location (such as on a rig floor, for example). Such control fluid is supplied to said actuator assembly through control fluid manifold assembly 7.

As said mandrel piston 70 provides upward force on central mandrel 161, external actuator piston 40 provides opposing downward force on upper connection member 167. As central mandrel 161 is forced upward, casing push bar 170 imparts downward force on slip dies 163, causing said slip dies 163 to ride down tapered surfaces 162 and, in turn, urging said slip dies 163 outward until said slip dies 163 are in gripping engagement against the inner surface of pipe section 310.

When release of said gripping assembly from said pipe is desired, the release process of actuation assembly 10 depicted in FIG. 21 is employed. In such case, casing push bar releases from slip dies 163, allowing compression spring 171 to impart upward force on said slip dies 163 and move such slip dies 163 out of gripping engagement with the inner surface of pipe section 310.

Because all control lines are connected to single control fluid manifold assembly 7, which in turn quickly and easily connects to the swivel assembly, the present invention eliminates the need for personnel to connect individual control lines or hoses to the pipe running assembly of the present invention. As a result, the chance of improper connection of such lines or hoses is greatly reduced. Further, safety is improved, because personnel are not required to connect/disconnect such individual lines/hoses at elevated locations.

Further, the pipe running assembly of the present invention permits easy and efficient conversion between pipe gripping methods (that is, gripping the inner or outer surface of pipe). By changing a modular pipe gripping assembly, the pipe running assembly of the present invention can be quickly and inexpensively converted from an internal pipe gripping device to an external pipe gripping device, or vice versa. Further, the pipe running assembly of the present invention permits the transfer of torque, as well as the flow of drilling mud or other fluids, though said device. As such, the pipe running assembly of the present invention (including, without limitation, pistons and other elements having spline profiles) permits the rotation and reciprocation of pipe, as well as the circulation of drilling mud or other fluids through said assembly, during the pipe installation process.

Additionally, the pipe running assembly of the present invention traps control fluid pressure downstream of a check valve assembly that isolates said pressure from the fluid swivel assembly of the present invention. As a result, once a target pressure has been achieved and the gripping assembly of the present invention has been actuated, fluid pressure can be relieved from said fluid swivel assembly. The hydraulic sealing elements of a fluid swivel assembly, such as sealing elements 97 of swivel assembly 90, relax and are cooled by circulating flow of such control fluid. As a result, said sealing elements of the swivel assembly of the present invention are not exposed to elevated pressures during rotation of the pipe running assembly of the present invention, thereby allowing said assembly to rotate at higher speeds without damaging said swivel sealing elements.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. A modular pipe running assembly comprising:

a) a fluid operated actuator assembly adapted to be connected to a top drive assembly, said actuator assembly comprising:

i) a control fluid swivel assembly having at least one fluid sealing element;

ii) a control manifold detachably connected to said swivel assembly for supplying control fluid to said swivel assembly;

iii) at least one fluid actuated piston;

iv) a check valve disposed between said swivel assembly and said at least one fluid actuated piston; and b) an interchangeable pipe gripping assembly connected to said actuator assembly, wherein said interchangeable pipe gripping assembly is actuated by said actuator assembly.

2. The modular pipe running assembly of claim 1, wherein said interchangeable pipe gripping assembly grips pipe on the external surface of said pipe.

3. The modular pipe running assembly of claim 1 wherein said interchangeable pipe gripping assembly grips pipe on the internal surface of said pipe.

4. The modular pipe running assembly of claim 1, further comprising a weight compensator.

5. The modular pipe running assembly of claim 1, wherein said check valve comprises a pilot-operated check valve having a control line, wherein said control line is routed through said control manifold.

6. A modular pipe running assembly comprising:

a) a fluid operated actuator assembly adapted to be connected to a top drive assembly, said actuator assembly comprising:

i) a control fluid swivel assembly comprising:

aa) a swivel sleeve member having an outer surface, a central bore defining an inner surface, a plurality of fluid channels disposed along said inner surface, and at least one bore extending from a channel to said outer surface defining a port;

bb) a body member rotatably received within the central bore of said swivel sleeve, wherein said body member has at least one bore aligned with and in fluid communication with a channel of said swivel sleeve;

cc) at least one sealing element disposed between fluid channels of said swivel sleeve, wherein said at least one sealing element forms a fluid pressure seal between said swivel sleeve and said body member;

ii) a control manifold detachably connected to said swivel assembly for supplying control fluid to said swivel assembly though said at least one port in said swivel sleeve;

iii) at least one fluid actuated piston;

iv) a check valve disposed between said swivel assembly and said at least one fluid actuated piston; and b) an interchangeable pipe gripping assembly connected to said actuator assembly, wherein said interchangeable pipe gripping assembly is actuated by said actuator assembly.

7. The modular pipe running assembly of claim 6, wherein said interchangeable pipe gripping assembly grips pipe on the external surface of said pipe.

8. The modular pipe running assembly of claim 6, wherein said interchangeable pipe gripping assembly grips pipe on the internal surface of said pipe.

9. The modular pipe running assembly of claim 6, further comprising a weight compensator.

10. The modular pipe running assembly of claim 6, wherein said check valve comprises a pilot-operated check valve having a control line, wherein said control line is routed through said control manifold.

* * * * *